US006938703B2

(12) United States Patent
Herrmann

(10) Patent No.: US 6,938,703 B2
(45) Date of Patent: Sep. 6, 2005

(54) AUTOMATED POST DRIVER

(76) Inventor: Timothy P. Herrmann, R.R. 1, Box 135C, Theilman, MN (US) 55978

( * ) Notice: Subject to any disclaimer, the term of this patent is extended or adjusted under 35 U.S.C. 154(b) by 0 days.

(21) Appl. No.: 10/619,894

(22) Filed: Jul. 15, 2003

(65) Prior Publication Data

US 2004/0011539 A1 Jan. 22, 2004

Related U.S. Application Data

(63) Continuation of application No. 09/654,794, filed on Sep. 5, 2000, now Pat. No. 6,591,919.
(60) Provisional application No. 60/152,185, filed on Sep. 2, 1999.

(51) Int. Cl.[7] ..... E21B 15/04
(52) U.S. Cl. ..... 173/42; 173/45; 173/46
(58) Field of Search ..... 173/42, 45, 46, 173/184

(56) References Cited

U.S. PATENT DOCUMENTS 3,117,635 A * 1/1964 Deerkoski ..... 173/28
3,696,625 A * 10/1972 Alexander ..... 405/303
3,703,934 A * 11/1972 Cartner ..... 173/193
3,783,953 A * 1/1974 Kopaska ..... 173/187
3,934,655 A * 1/1976 Whistle ..... 173/46
4,050,526 A * 9/1977 Deike ..... 173/27
4,124,081 A * 11/1978 Deike ..... 173/28
4,915,180 A * 4/1990 Schisler ..... 173/185
5,104,264 A * 4/1992 Castagner et al. ..... 405/244
6,158,923 A * 12/2000 Wheeler et al. ..... 405/116
6,517,294 B2 * 2/2003 Vreeland ..... 405/302.7

FOREIGN PATENT DOCUMENTS

WO 91/09194 * 6/1994

* cited by examiner

*Primary Examiner*—Louis K. Huynh
*Assistant Examiner*—Gloria R. Weeks
(74) *Attorney, Agent, or Firm*—Nawrocki, Rooney & Sivertson, P.A.

(57) ABSTRACT

A post driving apparatus includes a chassis having a longitudinal axis and a frame carried by the chassis. The frame includes an upper support member having an axis of elongation substantially perpendicular to the longitudinal axis of the chassis. A post magazine is indexingly supported by the frame and, a post driving assembly is suspended from a portion of the upper support member for reversible travel therealong so as to laterally position the post driving assembly from the chassis. The post driving assembly includes a post driver adapted to retain a post supplied from the post magazine, the post driver adapted to continuously drive such post.

19 Claims, 18 Drawing Sheets

AUTOMATED POST DRIVER

This is a continuation of application Ser. No. 09/654,794 filed on Sep. 5, 2000, now Pat. No. 6,591,919.

This is a regular application filed under 35 U.S.C. §111(a) claiming priority under 35 U.S.C. §119(e)(1), of provisional application Ser. No. 60/152,185, filed Sep. 2, 1999 under 35 U.S.C. §111(b).

TECHNICAL FIELD

The present invention generally relates to fence construction, more particularly, it relates to a method and apparatus for deploying posts from a supply of posts, and individually driving them continuously, consistently, and accurately.

BACKGROUND OF INVENTION

Although the wild west is not nearly as wild as it once was, the demand for fencing open space continues. A reality confronted by farmers, livestock managers, and more generally property owners seeking to keep animals and the like out of a predetermined area, is that fence installation is particularly time consuming, requiring a crew of three, usually more, and at least one support vehicle from which post may be dispensed in addition to the driving machine, if one may be reliably and accurately used to place posts for fence construction.

Conventional heretofore known post drivers pound posts into the ground as best they can using a reciprocating weight. Past improvements in the post driving art have primarily focused upon resetting or otherwise reestablishing a striking position for a drop hammer or the like. Mechanisms such as hydraulic motors in combination with sprocket chain drive assemblies, for linking the weight or hammer to the motor have been disclosed, as well as various arrangements of hydraulically or pneumatically powered block and tackle assemblies.

Heretofore known machines suffer a variety of shortcomings. For instance, on account of the mass (i.e., weight and physical dimension) of the drop hammer, the frame supporting it for vertical reciprocating movement must be commensurately massive. Similarly, large assemblies and subassemblies are typically necessitated to minimize component damage due to the repetitive and near constant hammer free fall, with components tending to prematurely wear or break. Accurate soil penetrating depth is not easily controlled with such machines, with great potential for post damage by repetitive striking blows from the drop hammer.

If not a more significant concern than the aforementioned shortcomings, at least on par therewith, is the matter of efficiency. Heretofore known post driving machines are plagued with inefficiencies, as numerous starts and stops are necessitated in the operation thereof. First, there is the non-continuous nature of drive hammer operation—half of the "drive" cycle is spent not driving a post (i.e., it is spent returning the drop hammer to a drop height). Next are the inherent subordinate steps associated with post driving, things such as post acquisition, post loading, or post positioning and alignment, etc. These subordinate activities in most cases take as much time, if not more time, as hammering the post into the ground. Needless to say, as the day progresses, the efficiency of the human operators is greatly reduced.

For these reasons, it is advantageous to provide a supremely efficient post driving apparatus and method. More particularly, it is desirable to provide a mechanically efficient post driver capable of receiving a post from an "on board" replenishable supply of posts, which continuously, consistently and accurately places posts, and is further capable of deploying fencing for securing thereto.

SUMMARY OF THE INVENTION

A post driving apparatus includes a chassis having a longitudinal axis and a frame carried by the chassis. The frame includes an upper support member having an axis of elongation substantially perpendicular to the longitudinal axis of the chassis. A post magazine is indexingly supported by the frame and, a post driving assembly is suspended from a portion of the upper support member for reversible travel therealong so as to laterally position the post driving assembly from the chassis. The post driving assembly includes a post driver adapted to retain a post supplied from the post magazine, and to continuously drive such post.

More specific features and advantages obtained in view of those features will become apparent with reference to the drawing FIGS. and DETAILED DESCRIPTION OF THE INVENTION.

DETAILED DESCRIPTION OF THE INVENTION

Figure 1A:
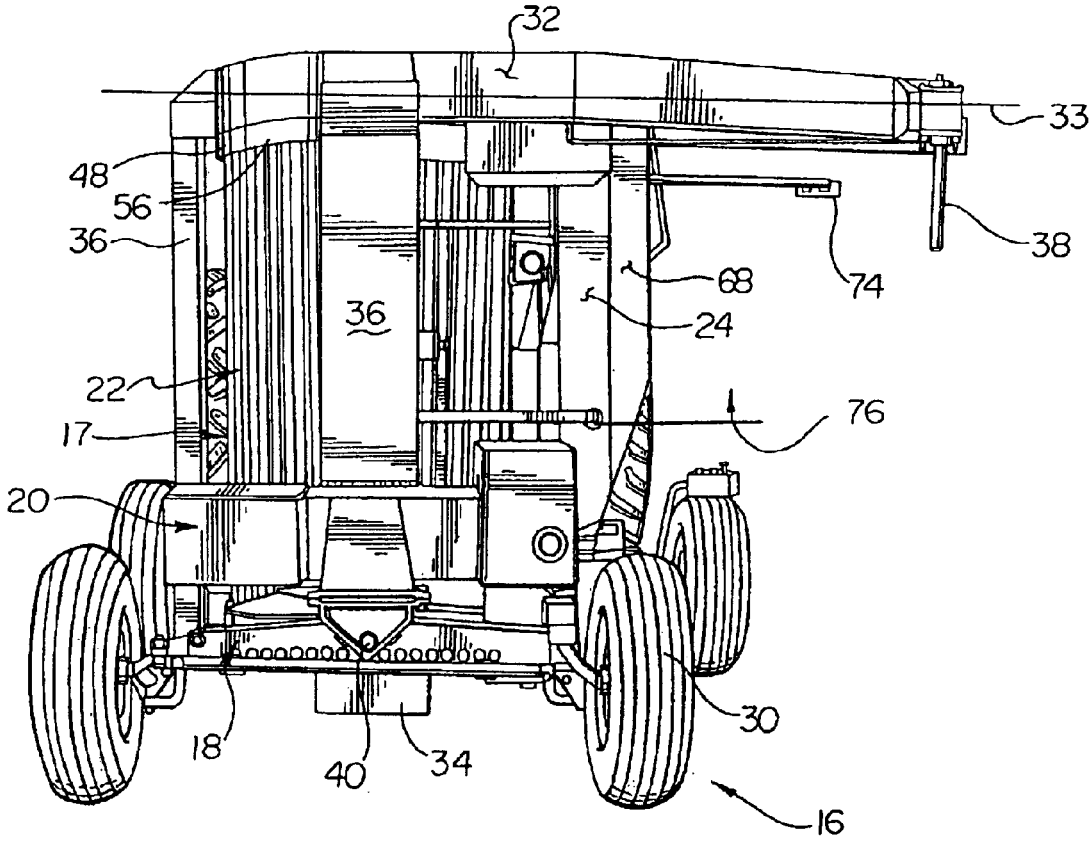
FIG. 1A is a rear elevational view of the post driving apparatus of the subject invention.

Referring generally to FIGS. 1A–1D, the post driving apparatus 16 of the subject invention includes a chassis 18, a frame 20 carried thereon, a post magazine 22 indexingly supported by the frame 20, and a post driving assembly 24 suspended from a portion of the chassis mounted frame 20. The apparatus 16 may be self propelled, or adapted to be towed behind a vehicle such as a tractor or the like, as is particularly illustrated in FIGS. 1C and 1D, wherein the apparatus 16 is powered by a tractor's power take-off 15, the output being at about 450 rpm. The power take-off 15 runs both a hydraulic pump, which generally supplies about 1200 pounds per square inch to the hydraulic system for pivoting, translating, etc. components of the apparatus via hydraulic rams (i.e., cylinders and pistons), and an alternator which supplies 12 volts direct current to a conventional controller, and otherwise satisfies the electrical requirements of the apparatus.

The chassis 18 generally has a longitudinal axis 19 (i.e., an axis extending throughout its length), and includes front 26 and rear 28 axles attached thereto, each axle supporting ground engaging wheels 30. For the sake of discussion, and as a matter of convention, the "rear" of the apparatus is the free end thereof (i.e., the end opposite the joined end), thus the "rear" axle is the shorter of the two (FIG. 1A), or said another way, the rear axle is shown as having a shorter wheel base than that of the front axle (FIG. 1A).

Figure 4:
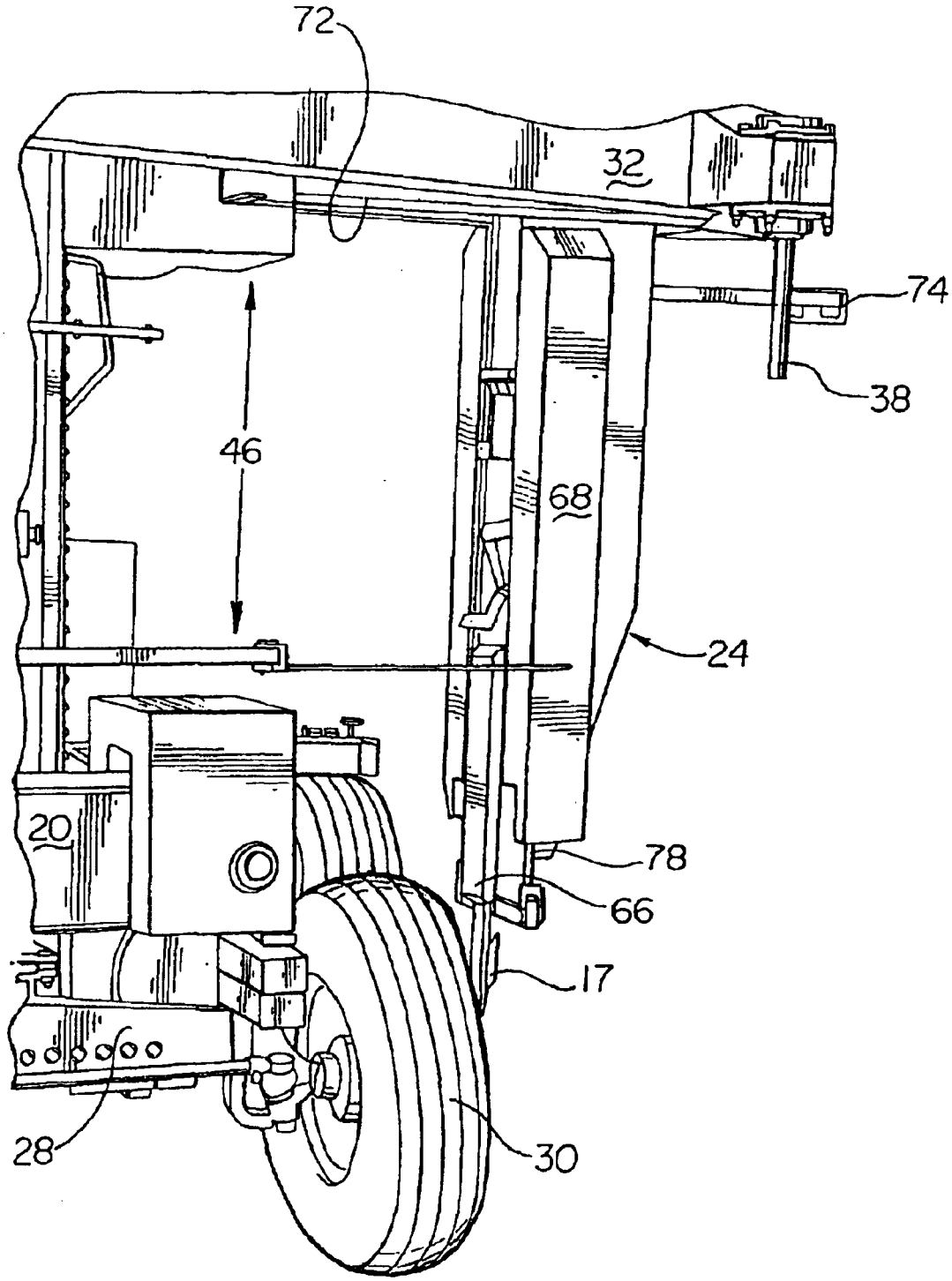
FIG. 4 is a rearward perspective view of the post driver of the subject invention, particularly showing post driver displacement.

The frame 20 generally includes upper 32 and lower 34 support members which are joined by structural columns 36, which, in addition to carrying the upper support member 32, house hydraulic, power and/or control lines for the apparatus. The upper support member 32, which is shown supported by three structural columns 36 in a spaced apart condition over the lower support member 34, has an axis of elongation 33 substantially perpendicular to the longitudinal axis 19 of the chassis 18, as best seen in FIGS. 1A and 1D. The frame 20 is generally equipped with at least one "fence" spool 38 from which fencing is dispensed. This is best seen in FIGS. 1A and 4 wherein the spool 38 depends down from the upper support 32 member of the frame 20 for rotation with respect thereto, as by being received in a bearing or the like. The wire or wire mesh fencing is attached to the spool 38 which rotates as the apparatus 16 is moved, thus dispensing the fencing material as the posts are planted.

Figure 2A:
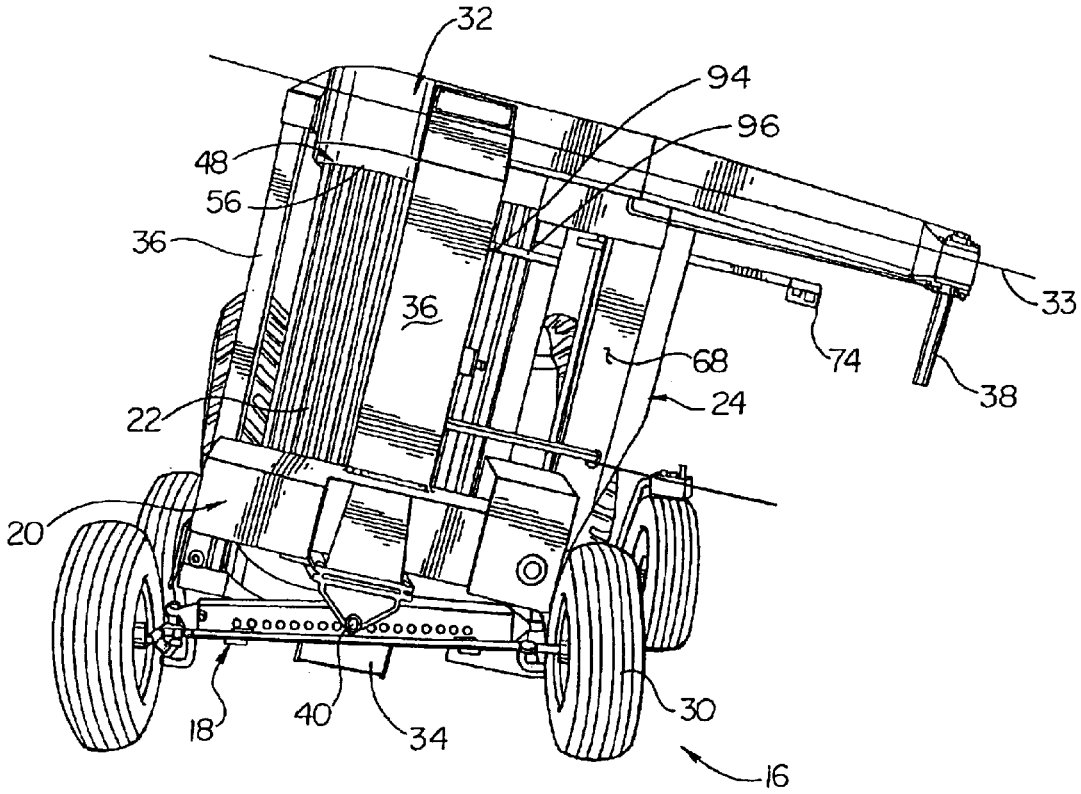
FIG. 2A is an elevational rear view of the subject invention showing the frame in tilted condition.
Figure 2B:
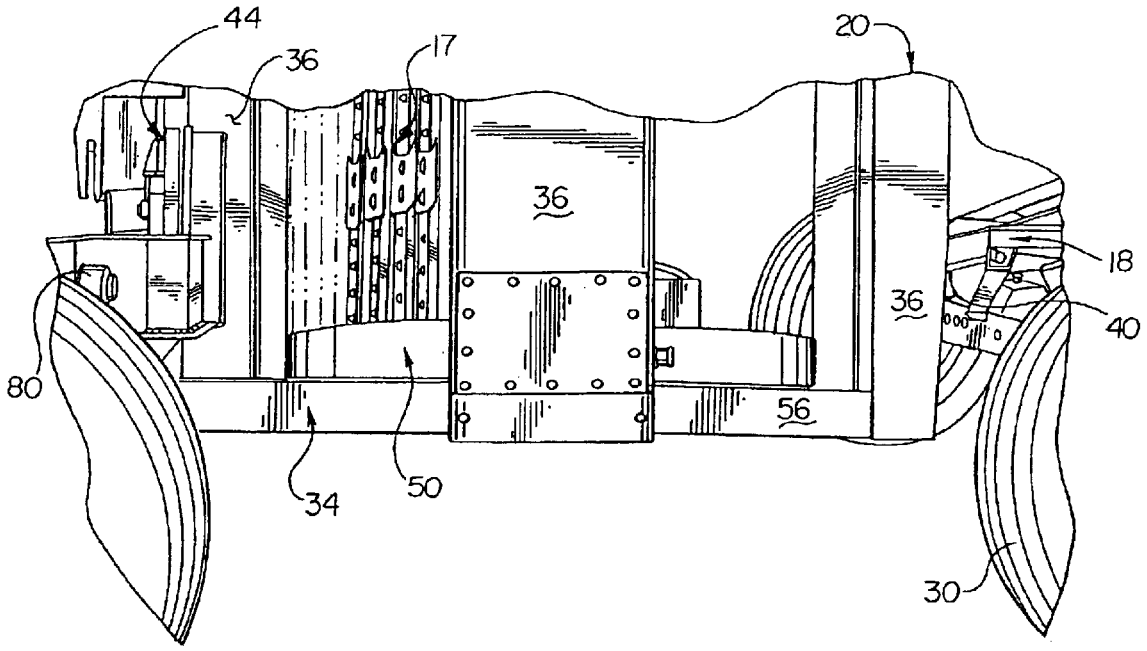
FIG. 2B is a elevational side view of the subject invention depicting the frame in a tilted condition and particularly illustrating the lower support member of the frame.

The frame 20 is preferably, but not necessarily, joined to the chassis 18 for pivoting/tilting with respect thereto. FIGS. 2A–2D generally show the apparatus 16 in a "tilted" condition (i.e., the frame 20 in a tilted condition relative to the chassis 18 so as to facilitate post placement when confronted with variable topography). The rear pivot linkage 40 between the frame 20 and chassis 18 is centrally located, as best seen in FIGS. 1A and 2A, whereas the front pivot linkage 42 is offset from the chassis centerline, more particularly, as best seen in FIG. 2D, to the side of the apparatus 16 from which the upper frame support member 32 laterally extends. A vertically aligned hydraulic ram 44, positioned adjacent to the forward most structural column 36, and partially visible in FIGS. 1C and 2C, further joins the frame 20 to the chassis 18 in the front end of the apparatus 16. This hydraulic ram 44 (a/k/a, leveling or tilting cylinder), when actuated, tiltingly positions the frame 20 with respect to the chassis 18.

The post magazine 22 is indexingly carried by the frame 20, more particularly, the post magazine 22 is interposed for selective rotation (i.e., indexing) between the upper 32 and lower 34 support members of the frame 20. The post magazine, or carousel 22, is vertically oriented within the frame 20 (i.e., the magazine resembles a cylinder, with the supply of posts appearing as an upstanding wall therefore), see FIGS. 1A–1D. Although steel tee posts (i.e., steel posts having a tee shaped cross section, or which are otherwise flanged, note the post 17 of FIG. 10) are depicted throughout the FIGS., other post styles (e.g., steel or wood posts of round cross section) are readily accommodated by the apparatus, as will later become apparent. The function of the post magazine 22 is to generally provide a spaced apart supply of posts, and to present each post 17 of the supply of posts quickly and efficiently to, and at a "transfer area" 46 (i.e., a post loading or pick up station) wherein a post positioned for removal from the magazine 22 is transferred directly or indirectly from the magazine 22 to the post driving assembly 24.

The post magazine 22 generally includes upper 48 and lower 50 post racks and a vertically aligned central shaft 52 which supports the racks 48/50 for indexed rotation. The central shaft 52 is held between bearings housed in the upper 32 and lower 34 frame support members. An indexing motor and magnetic brake (not shown), each of conventional design and well known to those of skill with such devices, selectively and incrementally rotates the shaft 52 for individual post presentation in furtherance of supplying a post 17 to the post driving assembly 24.

The post racks 48/50 are spaced apart on the magazine shaft 52 in parallel horizontal planes (i.e., the racks are substantially but not necessarily perpendicular with the shaft). Although two racks are shown, a lesser or greater number may be more advantageous, this determination being a function of post length (e.g., a rack might be positioned intermediate to the upper and lower racks). Preferably the lower post rack 50 holds or retains the "base" ends of the posts (i.e., the ground entering portion) in spaced apart condition (see FIGS. 2B and 2C), whereas the upper post rack 48 maintains a vertical alignment for each of the posts (i.e., maintains the spaced apart base condition substantially throughout the post length, see FIG. 1C). Thus, although the racks 48/50 are shown retaining the opposing post ends, the "upper" rack need not do so. As a matter of fact, posts in excess of about 9 feet (i.e., the preferred distance between the upper 32 and lower 34 frame support members) are often times desired to be installed, in which case the upper rack 48 retains a portion of each of the posts intermediate the opposing ends, with the upper frame support member 32 necessarily being adapted (e.g. slotted) to permit extension of the upper post ends therethrough so as to allow the necessary travel of the posts during apparatus operation (e.g., a generally circular route relative to the frame support members while being indexed in the magazine, and a linear path, laterally extending from the chassis, along the upper frame support member when travelling to a position for driven placement).

The racks 48/50 of the post magazine 22 generally include plates 54 and bands 56. The plates 54, best seen in FIGS. 1B, 2C, 8, and 9, generally function to align the posts within the magazine, and have a contoured (i.e., grooved or slotted) perimeter edge (note FIG. 2D) which defines peripheral seats 58 for the posts of the magazine. It is desirable to have available a plurality of rack plates 54, each having uniquely contoured peripheral seats 58 to accommodate a variety of post styles and dimensions, which can be readily exchanged one for another in the magazine 22, as by bolting to a central mounting ring (i.e., flange), not shown, about the shaft 52. The plates 54 are preferably equipped with spacers or dividers 60, particularly when driving steel tee posts, see for instance FIG. 4, to further insure proper overall alignment of the posts relative to each other in the magazine, and to thereby insure efficient transfer from the magazine 22 for receipt by the post driving assembly 24.

Figure 1B:
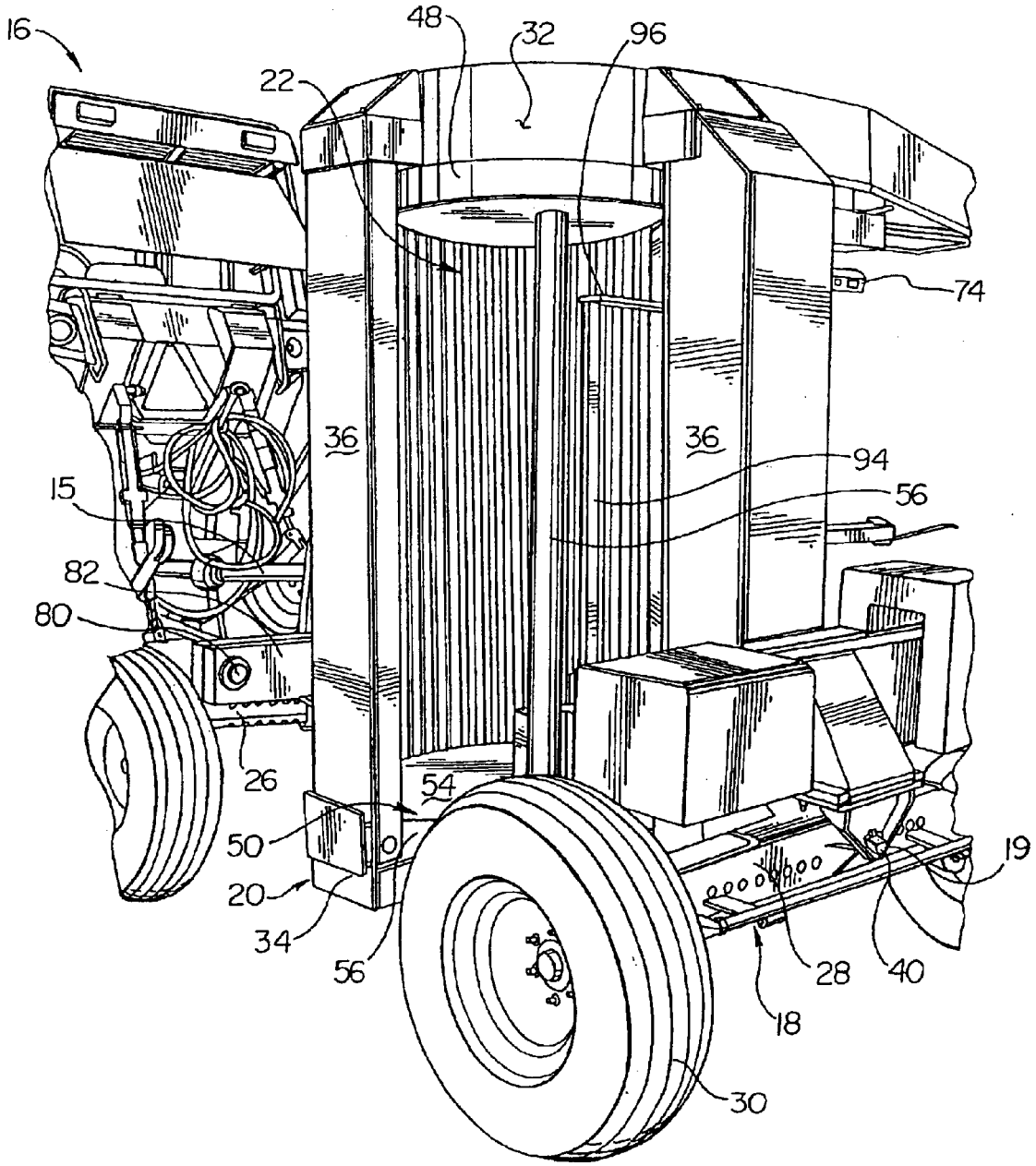
FIG. 1B is a rearward perspective view of the post driving apparatus of the subject invention, particularly showing the relationship between the magazine and the frame thereof.
Figure 1C:
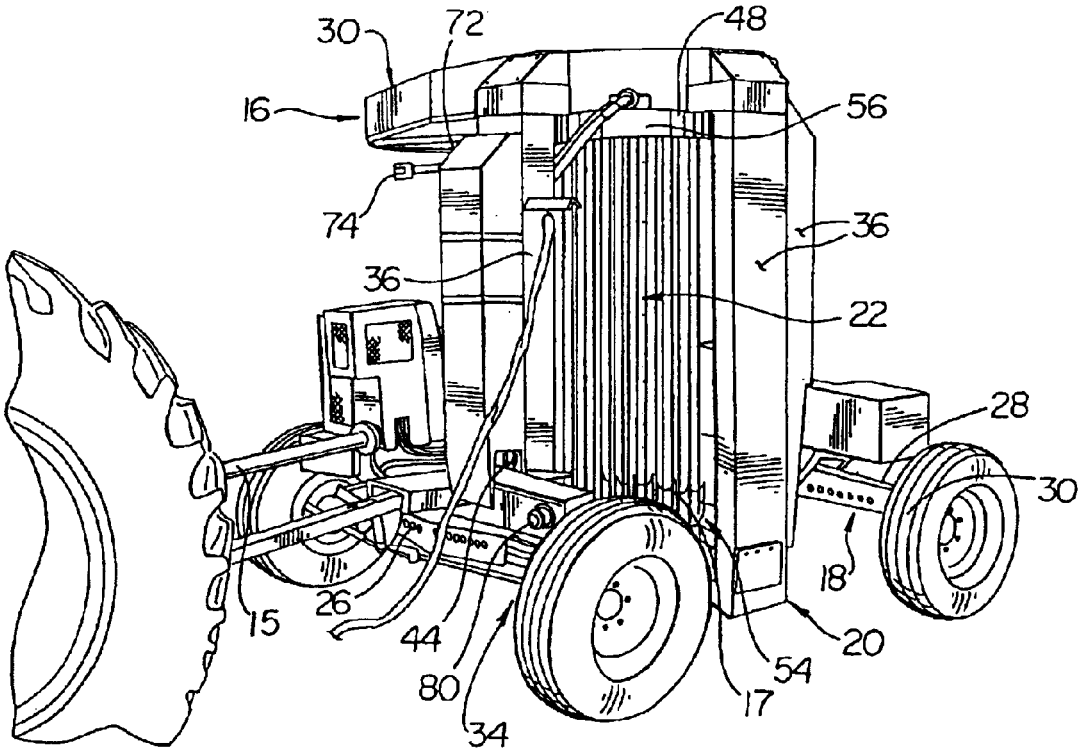
FIG. 1C is a forward perspective view of the post driving apparatus of the subject invention, particularly showing the driving pivot thereof.
Figure 1D:
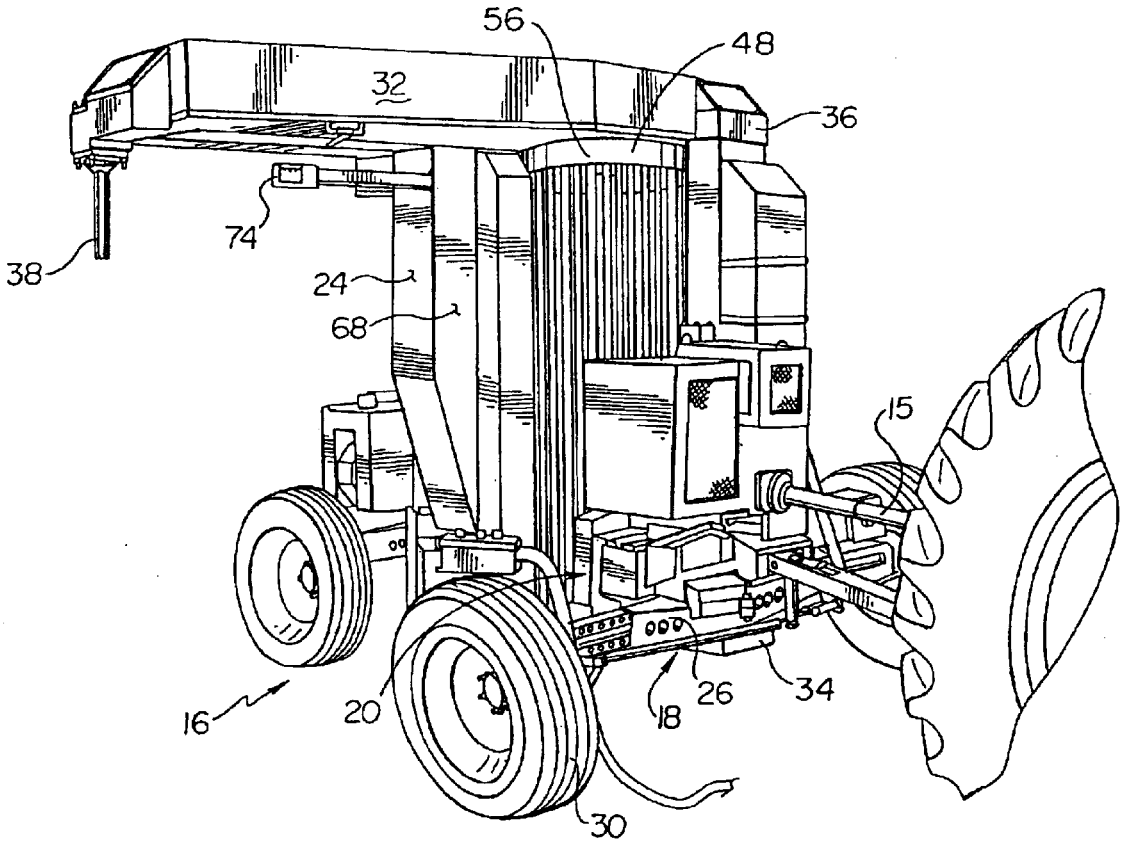
FIG. 1D is a forward perspective view of the post driving apparatus of the subject invention, particularly showing the relationship between the apparatus and towing vehicle, the post driver shown in a "home" position.

The bands 56, as best seen in FIG. 1B, generally retain the posts 17 in the magazine 22, more particularly, the bands 56 prevent "escape" (i.e., inadvertent radial displacement) of the supply of posts from their seats 58 during post driving operations. The retention function of the rings 56 is generally evidenced with reference to FIGS. 2A and 2B, wherein tilting of the frame 20 with respect to the chassis 18 without "spilling" posts is shown. As shown in FIG. 2B, the band 56 appears as an upstanding wall of a circular "tray" into which the post bases are received, with the tray generally secured to the lower frame support member 34. As shown, the "trays" effectively cap the opposing ends of the radially aligned posts. A similar arrangement is shown for the band 56 of the upper rack 48 in FIG. 1B. It should be noted that the bands or rings 56 may take a variety of forms, and may otherwise be supported by the frame 20 at either the support members 32/34 or structural columns 36, as for instance by welding, bolting, or other known means, or even formed integrally therewith.

Each of the bands 56 includes an aperture 62 (i.e., each of the bands is discontinuous throughout its circumference, or put another way, they are not a continuous loop) for ingress/egress of posts 17 from the magazine 22 during magazine loading and transference of a post positioned for direct or indirect pick up by the post driving assembly 24, the apertures 62 being in vertical alignment with each other, and in general, aligned with the travel path of the post driving assembly 24. It is advantageous that the apertures 62 of the bands 56 be adjustable (i.e., the spacing between opposing ends of the bands be selectively variable), as by a plate, or the like, slidable mounted to the band 56 so that posts of varying style may pass at least from the magazine 22 for loading into the post driving assembly 24 at or within the post transfer area 46.

The post magazine 22 preferably holds about 60 posts or ideally about a one hour supply. Although the magazine 22 requires periodic loading, as from a stowed "loose" supply thereof otherwise carried on board by the tow vehicle or the like, this may be completed efficiently by the operator, with the benefits of the post magazine far outweighing any perceived drawback. For instance, one person might hammer or otherwise pound 10–20 posts per hour for the first hour, with this number steadily decreasing as the day goes on using heretofore known post drivers. The apparatus of the subject invention can easily drive 40 to 60 posts per hour, every hour, all day, every day. With posts typically on ten foot centers, almost 1 mile of posts can be installed after about 8 hours of typical operation.

Referring now to FIGS. 1A, 1D, 3 and 4, the post driving assembly 24 is shown suspended from a portion of the upper support member 32 of the frame 20 for reversible controlled travel therealong. The post driving assembly 24 generally has a "home" position (FIGS. 1A and 1D) which is proximal to the post magazine 22 (i.e., within or at least adjacent to the post transfer area 46), and an away-from-home position (i.e., the selected post placement location, see FIGS. 3 and 4). In the home position, the post driving assembly 24 is ready to receive a post from the magazine 22, more particularly, a post which has been indexed into alignment with the apertures 62 of the bands 56 (i.e., a rack dispenser channel or slot 64) for dispensing therefrom. This post dispensing (from the post magazine) and loading (to the post driving assembly) procedure will be later discussed in detail and in relation to the post transfer mechanisms contemplated.

Figure 3:
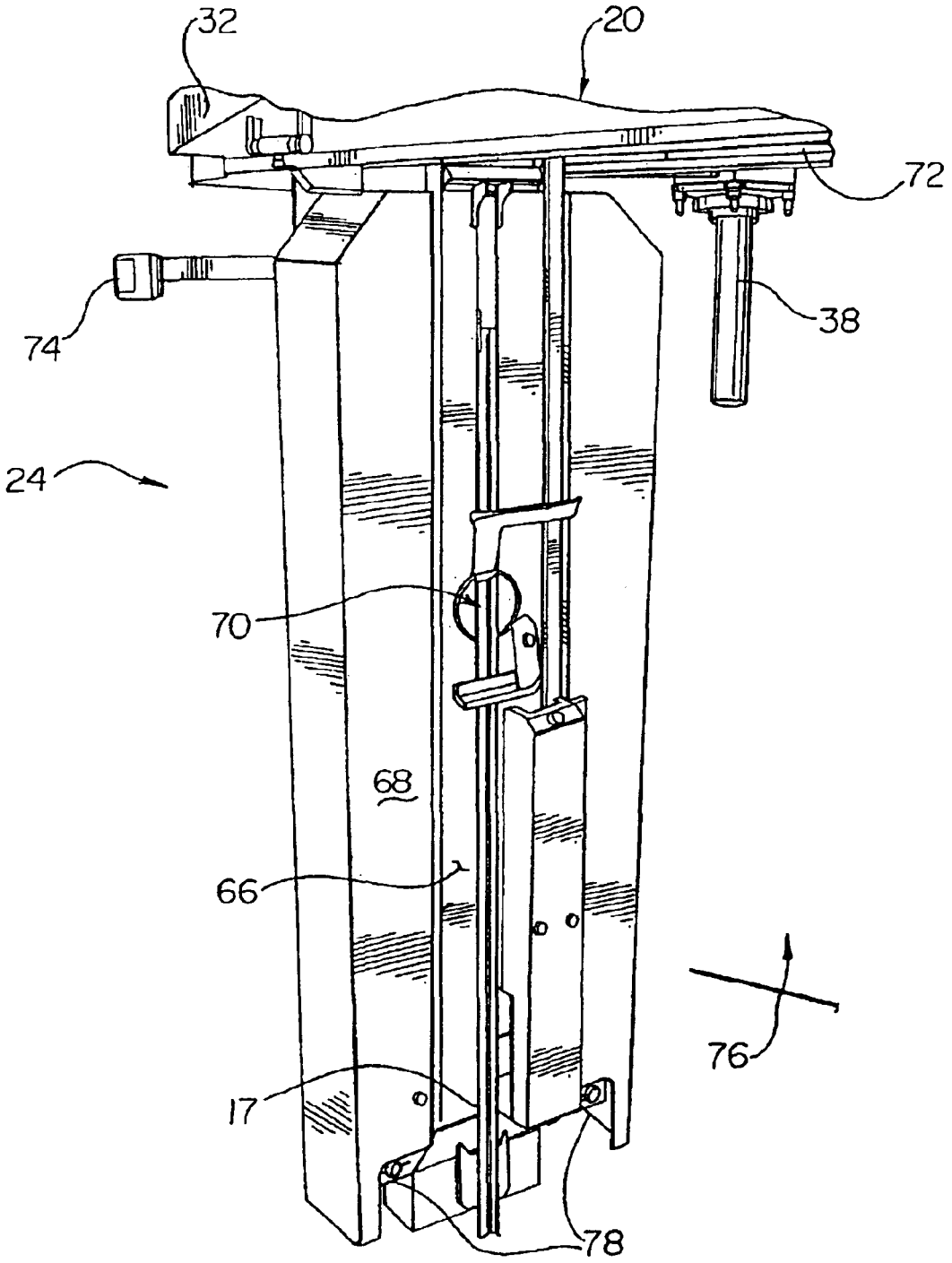
FIG. 3 is a forward perspective view of the post driver of the subject invention, particularly showing a post held/retained for driving by the driver.

Referring now to FIGS. 3 and 4, the post driving assembly 24 generally includes a post driver 66, adapted to receive and hold a post in contemplation of driven placement, a driver housing 68, and a travel carriage (not shown). The post driver 66 generally includes a post holding or retaining mechanism 70, (e.g., the rotating arms best seen in FIG. 3) for holding the post in a position for driven placement by the driver. Preferably, but not necessarily, the post driver 66 includes a post receiving structure, for instance a slot or channel positioned vertically in the post receiving surface of the driver, for receiving a flange of a steel tee post (see FIG. 10).

The post driving assembly 24 is capable of reversible travel along the upper support member 32 of the frame 20 so as to laterally position a post from the chassis 18. The upper support member 32, at least in the portion laterally extending beyond the chassis 18, is adapted to receive the travel carriage of the post driving assembly. Generally, rails or wheel receiving channels extend parallel to the axis of elongation 33 of the upper support member 32 within a carriage receiving channel 72. The travel carriage is equipped with support wheels (e.g., opposing front and rear wheels) which cooperatively engage the wheel receiving structure 72 of the upper support member 32. A hydraulic ram links or joins the travel carriage to the upper support member 32, actuation thereof translating the carriage, and thereby the post driving assembly 24, along the track of the upper support member 32. Although not shown, it may be readily appreciated that an augering device can be coupled to, or otherwise configured to move with, or as, the driving apparatus so as to facilitate post placement as post diameter and ground conditions (i.e., soil characteristics) warrant.

The travel distance of the post driving assembly 24 (i.e., displacement of the assembly 24 laterally from the chassis 18 for post placement) is generally controlled by detection of a laser by a laser light detector 74 positioned to extend outward from the rear of the post driver housing 68 a known and fixed distance. Upon determining and marking a boundary line (e.g., as by surveying or the use of ground positioning systems commercially available), a beam of laser light is easily generated and emitted relative to at least a portion of the marked line such that intersection of the beam by the detector 74 stops the post driving assembly 24 for precise placement of a post on the preselected and marked boundary (i.e., fence) line. After a post has been set, it is advantageous that the post driving assembly 24 extend to its lateral limit, relative to the chassis 18, along the upper support member 32 so as to "clear" the driven post as the apparatus operator moves the apparatus 16 to the next post placement location. As the apparatus 16 moves forward, a trip wire 76 (FIGS. 2D and 4) is displaced by the set post, which resets (i.e., repositions) the post driving assembly 24 to the home position. Return to the home position, including the transference of a post from the magazine 22 to the post driving assembly 24, is readily completed prior to reaching the next post placement location, thereby making for quick, efficient work.

The post driver 66 is controlingly actuated by a plurality of hydraulic rams 78, partially visible in FIG. 4, which vertically displace the driver 66 relative to the housing 68 to at least or only initially drive a post into the ground. As the hydraulic rams 78 begin to continuously set a post, without delivering repetitive blows as by reciprocating weight, a point is reached wherein a substantial portion of the mass of the apparatus is displaced, about a pivot point, and transferred from the ground engaging wheels 30, through the chassis 18, the frame 20, the post driving assembly 24 and to the post driver 66. At this time, the hydraulic rams 78 of the post driver 66 are operatively disengaged so that the displaced apparatus mass may bear upon the initially placed post and thus complete the post placement function.

Figure 2C:
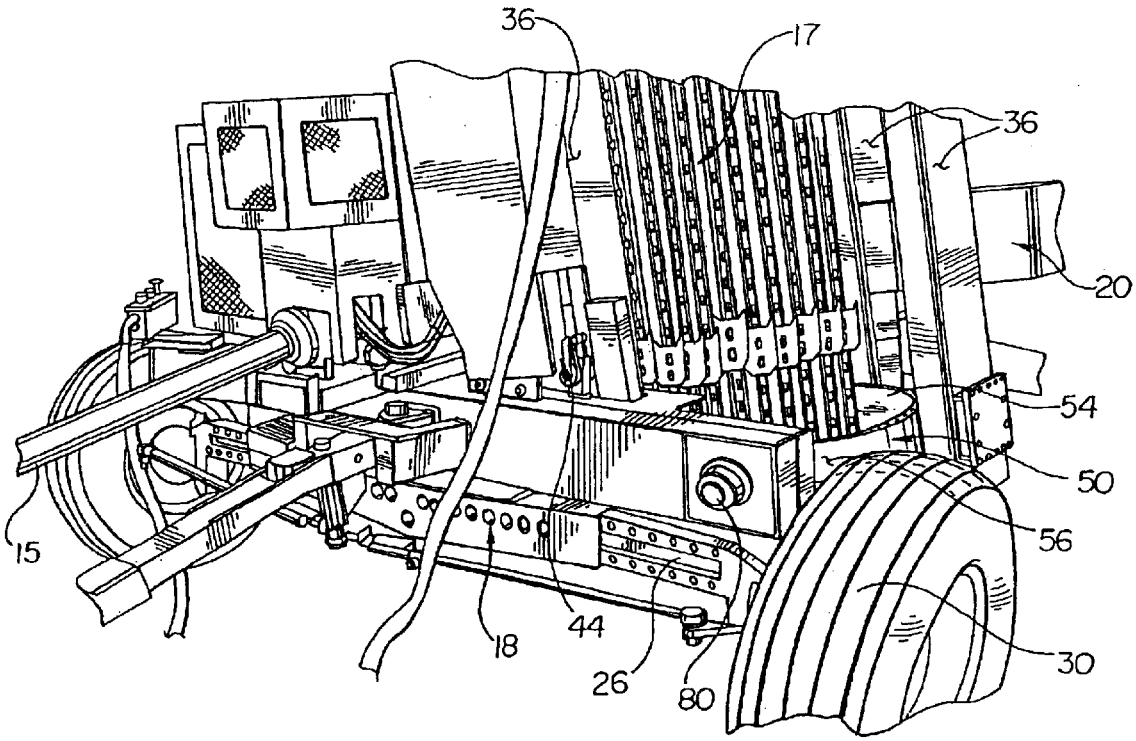
FIG. 2C is a forward perspective view of the subject invention depicting the frame in a tilted condition, particularly showing the tilting ram.
Figure 2D:
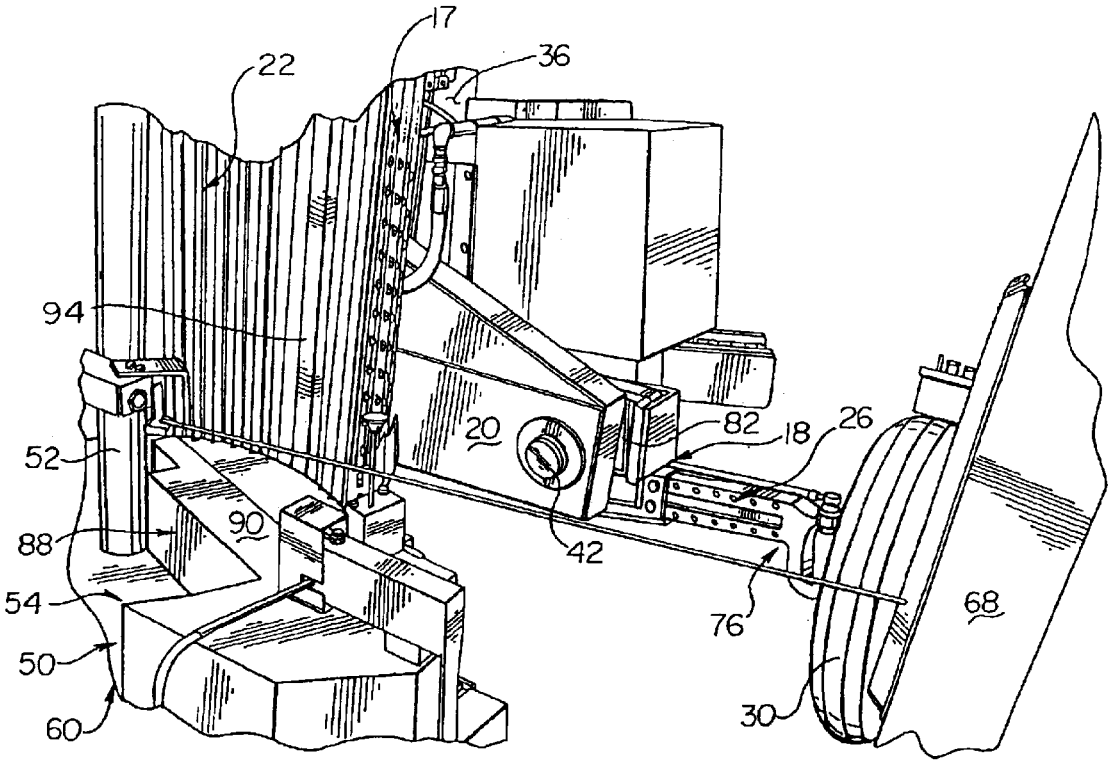
FIG. 2D is a rearward perspective view of the subject invention depicting the frame in a tilted condition, particularly showing the rear tilt pivot.
Figure 5:
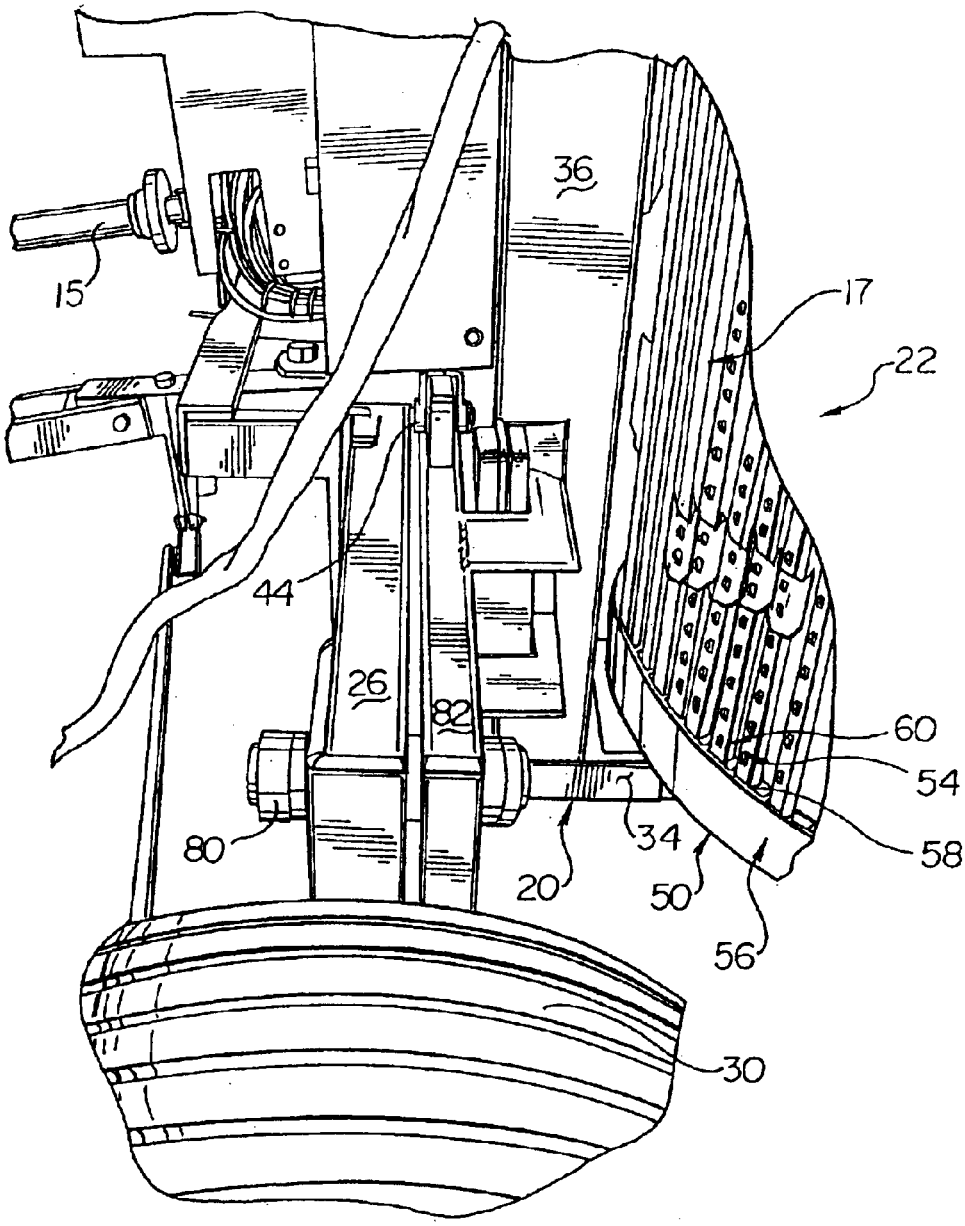
FIG. 5 is an overhead perspective view of the driving pivot of the subject invention.
Figure 6:
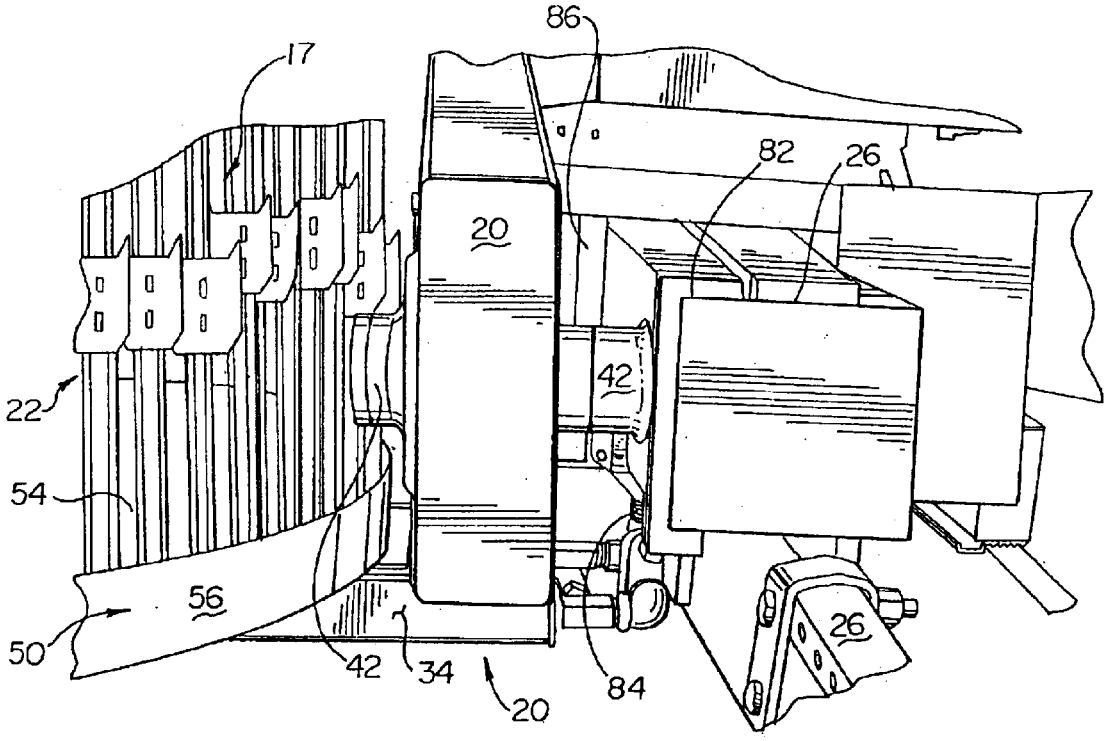
FIG. 6 is an elevational view of the rear tilt pivot of the subject invention, particularly illustrating the driving pivot control mechanism.

Referring now generally to FIGS. 2C, 5, and 6 a driving pivot 80 is shown in FIGS. 2C and 5 about which substantial apparatus mass is displaced in furtherance of post placement. More particularly, the driving pivot 80 is shown linking a portion of the frame 20, namely a leveling bar (i.e., the anchoring structure of the frame which supports the leveling cylinder 44) to the chassis 18 for relative movement thereabout. Components of a post driver ram bypass are generally shown in FIG. 6, in the vicinity of the forward tilting or leveling pivot 42 which, as previously noted, likewise joins the frame 20 to the chassis 18. The front axle 26 generally has top and bottom plates attached thereto or integral therewith. A spring loaded selector valve 84 is located on the front axle 26, adjacent the top plate, and controls the flow of hydraulic fluid through alternate hydraulic lines to operatively engage/disengage the post driver rams 78. There is a pivot or displacement distance of about 5/16" between the front axle 26 and the frame 20 such that as the initially placed post begins to displace the axle 26 about the driver pivot 80 (see FIG. 5), the spring loaded selector valve 84 is engages by the frame 20 and is thereby actuated by the displacement, thus diverting hydraulic fluid flow from the driver rams 78 to operatively disengage them (i.e., stops the flow of fluid to the driver rams). At this point the initially driven post effectively supports a substantial portion of the weight of the apparatus to thereby complete placement. Upon return of the axle to its initial configuration, a hydraulic ram 86 is automatically actuated to reset the selector valve 84 for supplying driver rams 78 and subsequent initial post placement.

Referring now generally to FIGS. 7–14, post transfer mechanisms are shown for loading a post into the post driver 66 of the driving assembly 24. The embodiment of FIGS. 7–9 contemplate a physical carrying of the post positioned for egress from the magazine, from the magazine to the post driver of the post driving assembly, whereas the embodiment of FIGS. 10–14 contemplate a capture or seizure of the post positioned for egress from the magazine by the post driving assembly itself. A discussion of each embodiment follows.

Figure 7:
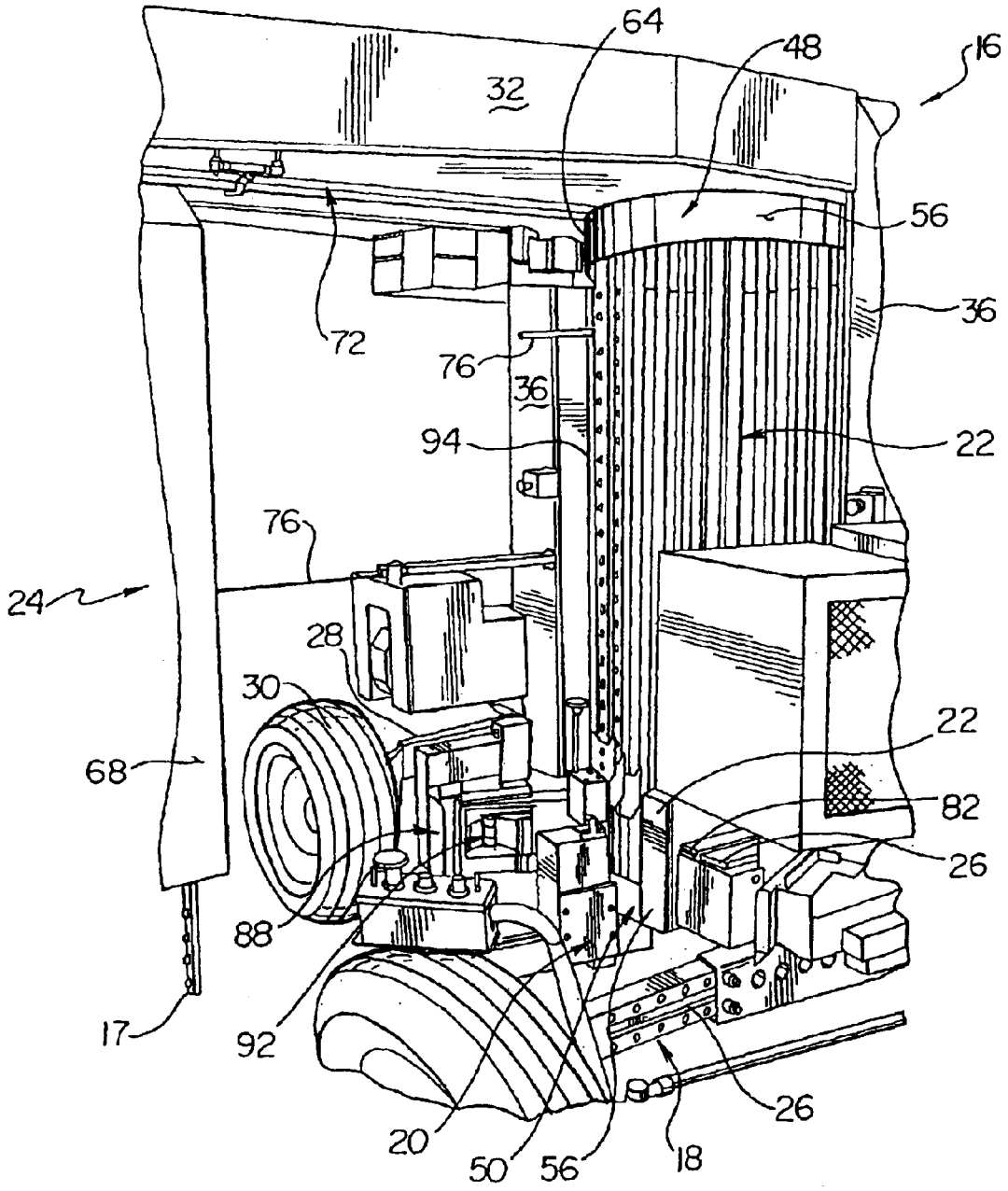
FIG. 7 is a detailed view of the post driving apparatus of FIG. 1D, particularly illustrating one style of post transfer mechanism, the post driver shown in an away-from-home position.
Figure 8:
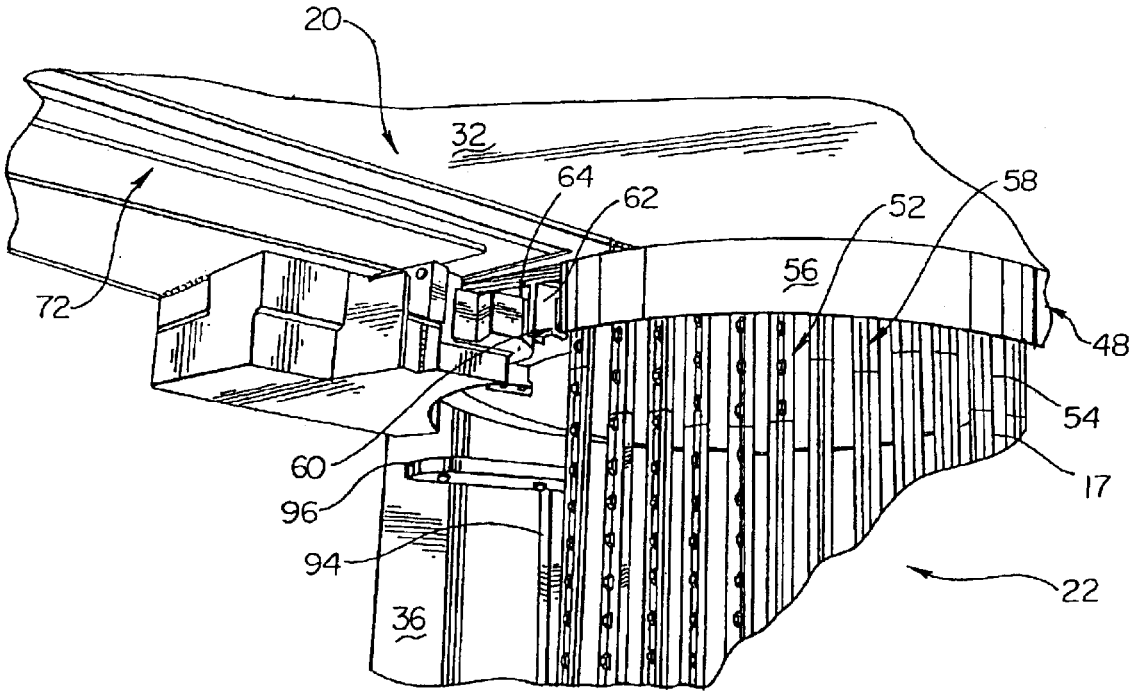
FIG. 8 is a detailed view of the upper portion of the post transfer mechanism of FIG. 7.
Figure 9:
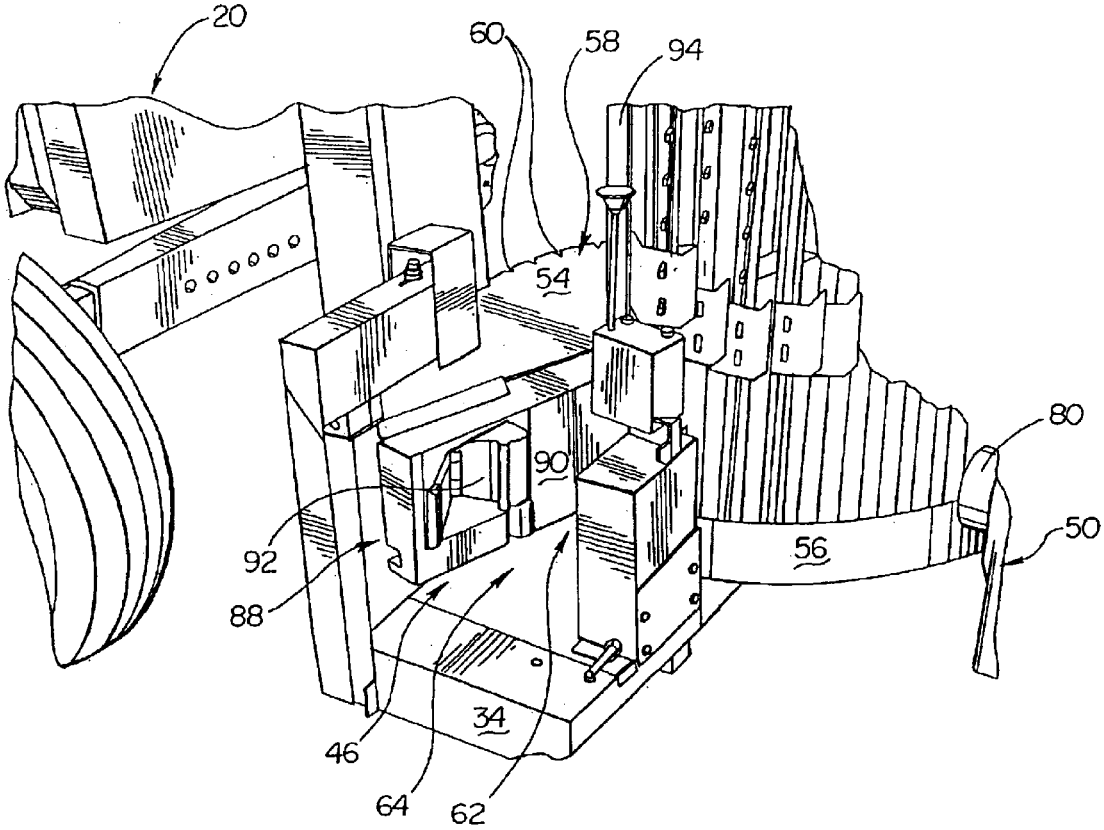
FIG. 9 is a detailed view of the lower portion of the post transfer mechanism of FIG. 7.

With reference to FIGS. 7–9, a post transfer mechanism 88 is shown supported by the frame 20 of the apparatus 16, with the mechanism 88 substantially positioned at or within the post loading or pick up station 46 (FIG. 9). The mechanism 88 generally includes a translatable grasper arm 90, a post holder 92 (e.g., a clamp or the like) at a distal end thereof, and a subordinate guiding arm 94 vertically extending from the grasper arm 90. The job of the grasper arm 90 is to transfer a post from the magazine 22 to the post driver 66 of the post driving assembly 24, for receipt thereby, while the assembly 24 is in a home position.

The driven grasper arm 90 (FIG. 9) is joined to the frame 20 at the lower support member 34 for back and forth travel, preferably but not necessarily by a hydraulic ram. The travel path of the grasper arm 90 generally extends from the magazine interior to the magazine exterior (i.e., is extendible through the aperture 62 of the band 56 of the lower post rack 50 of the magazine 22). The grasper arm 90, more particularly the post holder or grasper 92, is positioned (i.e., stopped along its travel path) to seize the post readied for egress from the magazine 22 (i.e., a post positioned in the rack dispenser channel or slot 64, an upper portion thereof shown in FIG. 8, along with an indexing finger), with the subordinate guide arm 94 positioned to guide and assist the transfer of the post by engaging an upper portion thereof. A post guide 96, as best seen in FIG. 8, is attached to the free end of the guide arm 94 for engaging and guiding the "grasped" post.

With reference to FIGS. 10–14, an alternate embodiment of the post transfer mechanism is shown supported by the post driving assembly 24, namely the driver housing 68. In this embodiment, at least two pivoting grasper arms 100 are vertically arranged in a spaced apart condition on the driver housing 68 (FIG. 11) for capturing a post positioned in the magazine 22 for transfer therefrom. With this mechanism, a post from the magazine 22 is directly grabbed, throughout a substantial portion of its length, by the grasper arms 100 when the post driving assembly 24 is in a home position (i.e., the sweeping arc of a grasper arm 100 effectively extends a portion thereof into the magazine 22 so as to engage the post from behind).

Figure 10:
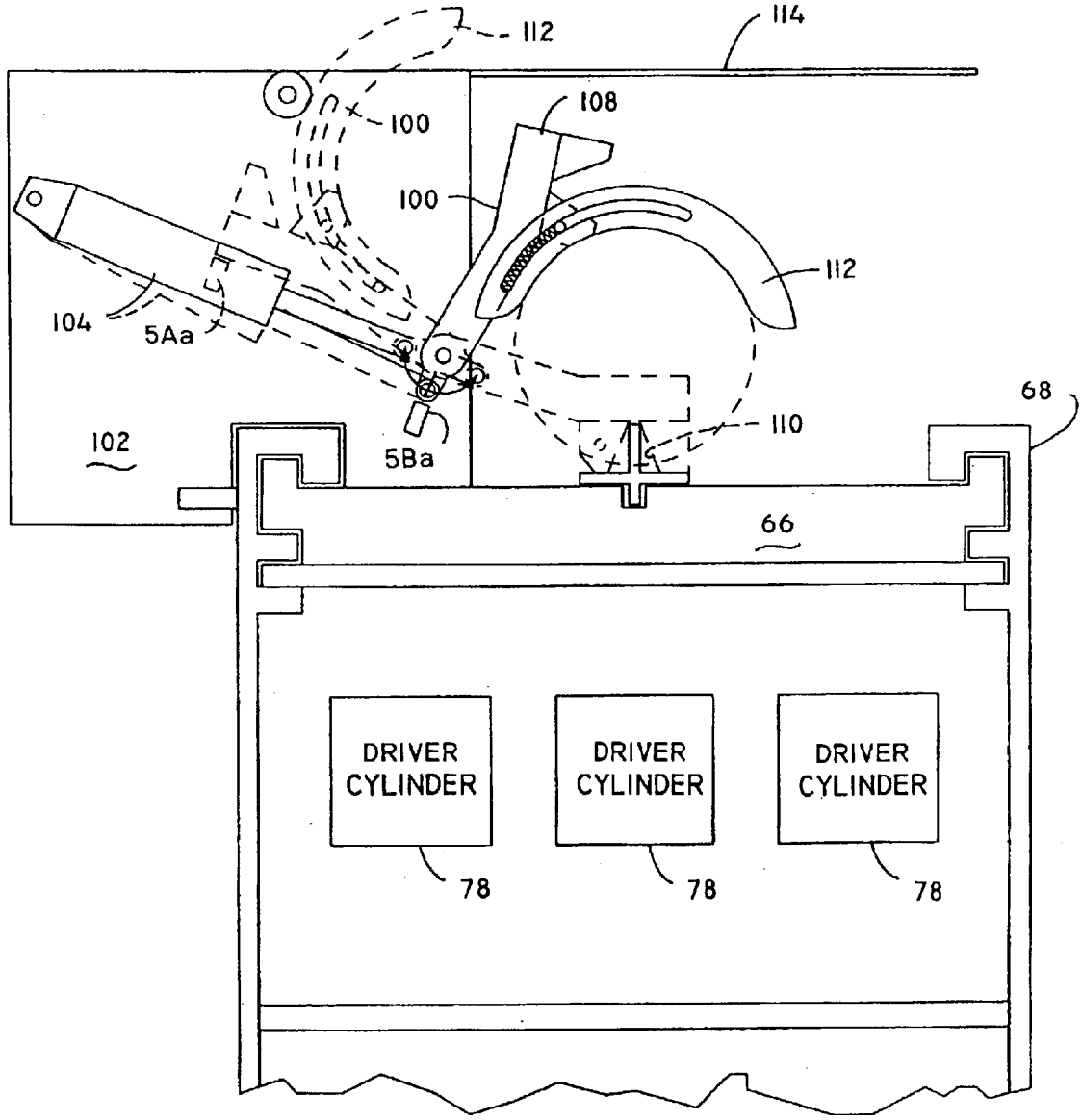
FIG. 10 is an overhead plan view of an alternate embodiment of the post driver, particularly showing an integral post grasper assembly.
Figure 11:
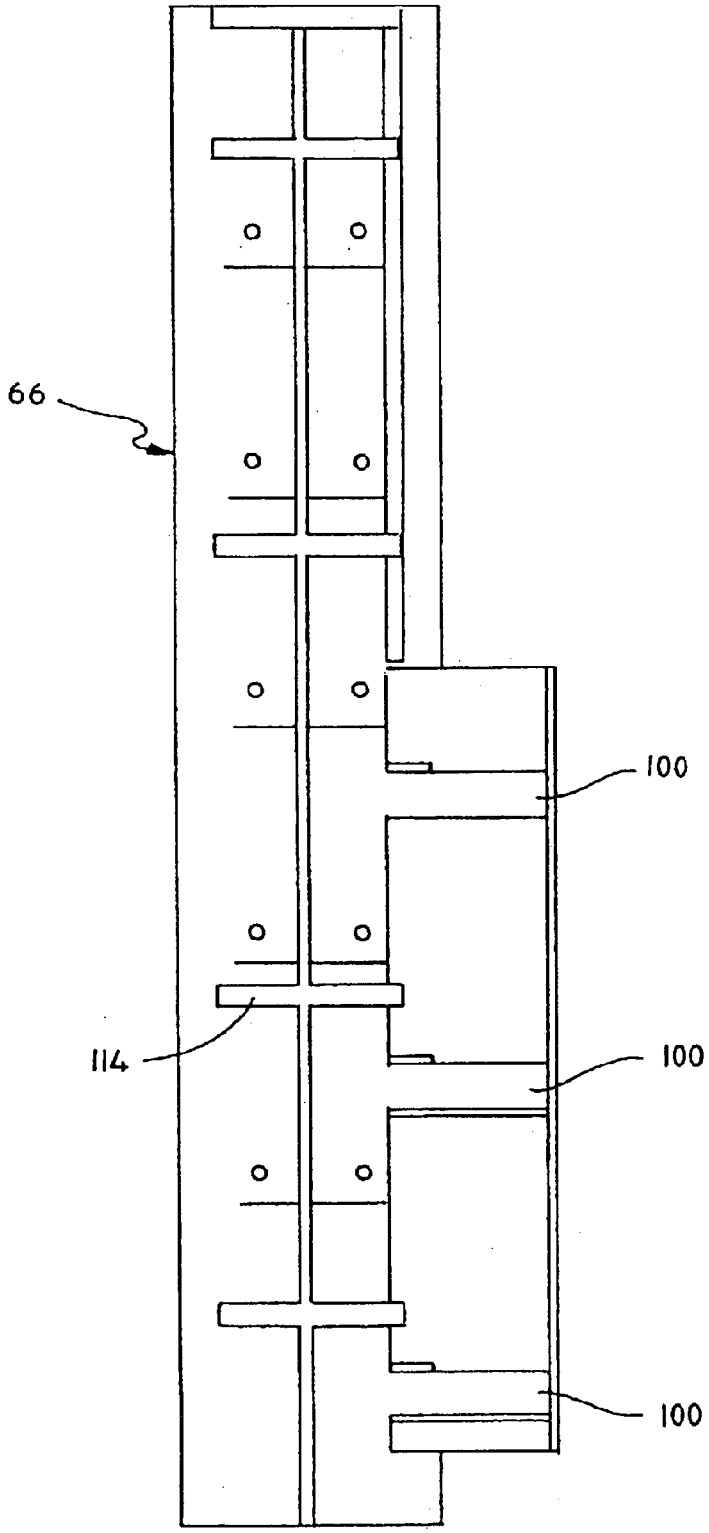
FIG. 11 is a front elevation view of the post driver of FIG. 7.
Figure 12:
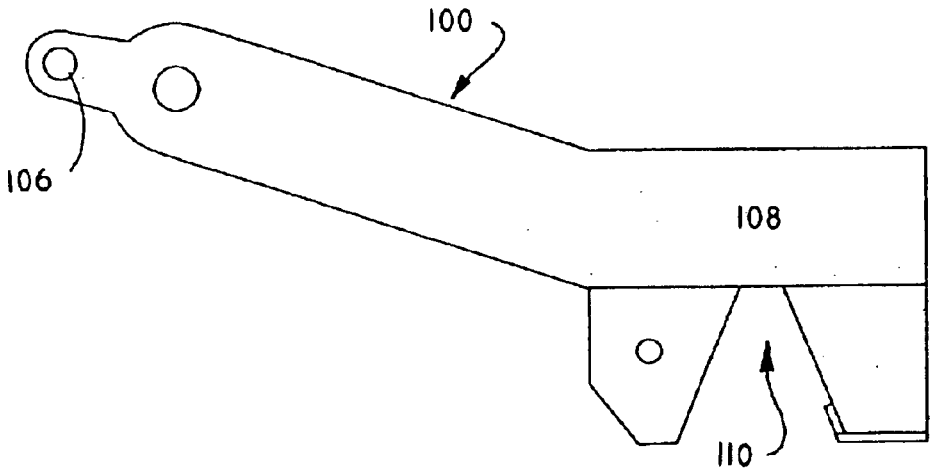
FIG. 12 is a overhead plan view of one embodiment of the grasper arm of the grasper of FIG. 10; and, FIG. 13 is an elevational view of the grasper arm of FIG. 9.
Figure 13:
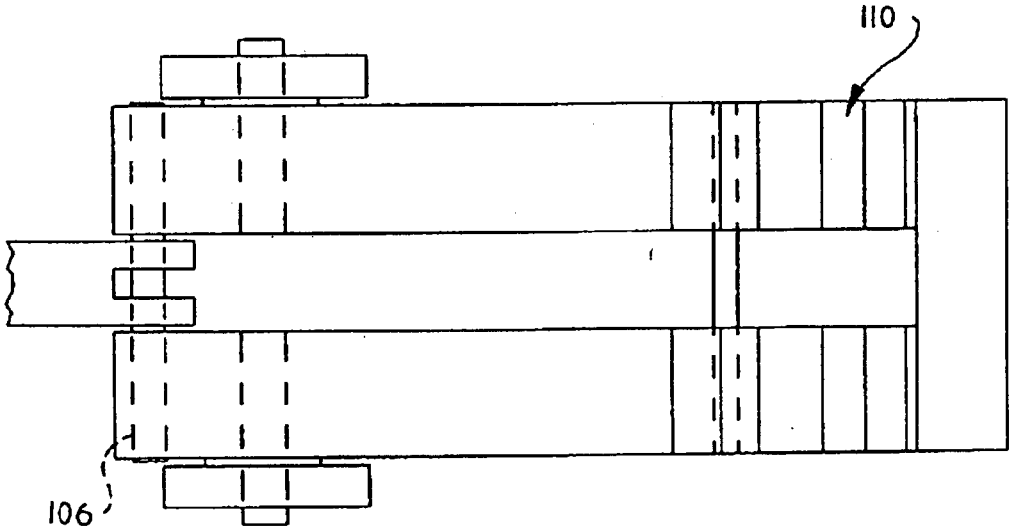

The grasper arms 100 are generally indirectly attached to the housing 68 by a mounting plate 102 which further supports a hydraulic cylinder 104 for pivoting the grasper 100 about a pivot point 106 (FIG. 10). Two styles of grasper arms are shown in FIG. 10, namely a steel tee post grasper 108 having a profiled post receiving surface 110 (see FIGS. 12 and 13), and a wood/steel post grasper 112 for posts having a round cross section. Each style of grasper arm shown in FIG. 10 is depicted in varying states of rotation about the pivot point.

Each mounting plate 102 is equipped with a hard yet flexible (i.e., resilient) finger 114 which extends so as to be substantially parallel to the post receiving surface 67 of the driver 66 (FIG. 10), effectively in a position between the post readied for egress from the magazine 22 and the post driving assembly 24. Each finger 114, when the post driving assembly 24 is "at home", is positioned to be adjacent the post within the rack dispensing channel 64, thereby maintaining the post in a substantially vertical position, and thus preventing premature egress of the post from the magazine and insuring that there will be a post positioned in the magazine for capture by the grasper arm 100. After initial engagement of the post by the grasper arm 100, the grasper arm 100 travels through its rotation for delivery of the post to the driver 66 of the post driving assembly 24, whereby the finger 114 is reversibly deflected in the process. Once the post is received by the post driver 66, the grasper arms 100 maintain tension thereon, effectively eliminating the need for post holding or retaining mechanism 70 as discussed in relation for FIGS. 3 and 4, while traveling to the away-from-home position for subsequent driven placement.

While a preferred embodiment of the present invention has been described, it should be understood that various changes, adaptations and modifications may be made therein without departing from the spirit of the invention. Changes may be made in details, particularly in matters of shape, size, material, and arrangement of parts without exceeding the scope of the invention. Accordingly, the scope of the invention is as defined in the language of the appended claims.

What is claimed is:

1. A post driving apparatus comprising:

a. a chassis having a longitudinal axis;

b. a frame carried by said chassis, said frame including an upper support member having an axis of elongation substantially perpendicular to said longitudinal axis of said chassis;

c. a post magazine indexingly supported by said frame;

d. a post driving assembly suspended from a portion of said upper support member for reversible travel therealong so as to laterally position said post driving assembly from said chassis, said post driving assembly including a post driver adapted to retain a post supplied from said post magazine; and e. wherein a portion of said chassis is displaced about a driving pivot so as to shift weight from said chassis to said driving assembly to thereby complete driven placement of a post retained by said post driver.

2. The post driving apparatus of claim 1 wherein a post retained by said post driver is continuously driven during driven placement.

3. The post driving apparatus of claim 2 wherein the apparatus is self propelled.

4. The post driving apparatus of claim 2 wherein the apparatus is adapted to be towed behind a vehicle.

5. The post driving apparatus of claim 1 wherein said post driver is initially driven by a hydraulic ram and subsequently driven by the displaced mass of said apparatus.

6. The post driving apparatus of claim 5 wherein said driving pivot is parallel with said longitudinal axis of said chassis.

7. The post driving apparatus of claim 5 wherein said frame is pivotally carried by said chassis.

8. The post driving apparatus of claim 7 wherein said frame is hydraulically pivoted about said longitudinal axis of said chassis so as to change the angular relationship between said post driving assembly and the ground surface.

9. The post driving apparatus of claim 8 wherein said apparatus further comprises means for transferring a post from said post magazine to said post driver for subsequent driven placement.

10. The post driving apparatus of claim 9 wherein said means is supported by said frame.

11. The post driving apparatus of claim 9 wherein said means is supported by said post driving assembly.

12. The post driving apparatus of claim 9 wherein said post driver has a home position, said home position defining a post transferring station for said apparatus.

13. The post driving apparatus of claim 12 wherein said post driver further has at least one away-from-home position, said at least one away-from-home position being the desired post location for post placement.

14. The post driving apparatus of claim 13 wherein said at least one away-from-home position is defined by laser detection of a laser emitted to delimit at least a portion of a preselected fence line.

15. The post driving apparatus of claim 14 wherein said apparatus further includes at least one fence dispenser, said at least one fence dispenser being positioned on said frame.

16. A post driving apparatus comprising a chassis having a longitudinal axis and a frame mounted thereto, a supply of posts carried by said frame for individually supplying posts to a post driver, said post driver being reversibly positionable with respect to said longitudinal axis of said chassis so as to laterally position a post from said chassis for driven placement, said chassis being displaceable by said post driver during post driving such that at least a substantial portion of the mass of said apparatus is borne by a post being driven thereby.

17. The post driving apparatus of claim 16 wherein said driven placement is continuous.

18. The post driving apparatus of claim 17 wherein said frame is tiltable relative to said chassis to vertically align said post driver relative to a variable topography.

19. In a method of continuously driving posts using a post driving apparatus having a chassis and a post driving assembly support frame, the steps comprising;

a. hydraulically driving a post for placement in the ground; and b. subsequently bearing upon said post a substantial portion of the mass of said apparatus to finally drive said post.

* * * * *